United States Patent [19]

Latimer

[11] 4,311,342

[45] Jan. 19, 1982

[54] DREDGE HEAD WITH MECHANICAL AND PUMPING ACTION

[75] Inventor: John P. Latimer, Newport News, Va.

[73] Assignee: Deepsea Ventures, Inc., Gloucester Point, Va.

[21] Appl. No.: 955,648

[22] Filed: Oct. 30, 1978

[51] Int. Cl.[3] ..... E02F 5/00

[52] U.S. Cl. ..... 299/8; 37/DIG. 8

[58] Field of Search ..... 299/8, 9; 37/DIG. 8, 37/57, 69, 70

[56] References Cited

U.S. PATENT DOCUMENTS

| | | | |
|---|---|---|---|
| 3,588,174 | 6/1971 | Rossfeld | 37/DIG. 8 |
| 4,010,560 | 3/1977 | Diggs | 299/8 |
| 4,035,022 | 7/1977 | Hahlbrock et al. | 299/8 |
| 4,037,874 | 7/1977 | Willums | 37/DIG. 8 |
| 4,053,181 | 10/1977 | Saito | 37/DIG. 8 |
| 4,147,390 | 4/1979 | Deliege et al. | 299/8 |

*Primary Examiner*—William F. Pate, III

*Attorney, Agent, or Firm*—Barry G. Magidoff

[57] ABSTRACT

This invention provides dredge means for obtaining ore and other particular material from the ocean floor. The dredge head utilizes a combination of hydrodynamic, pumping, effects plus mechanical dislodging and carrying means. Specifically, the dredge head comprises a powered rotating drum having radially extending tines partially surrounded by a shroud. The shroud diverges from the drum surface, so that it is nearest the drum surface at its forward and lowermost end and farthest from the drum at its rearward and uppermost end. Particles of ore collected by the rotating drum are conveyed to means for carrying the ore to the ocean surface. The hydrodynamic effects of the dredge head include a venturi effect at the inlet, a centrifugal pumping effect and a so-called Magnus effect.

20 Claims, 12 Drawing Figures

12
2
2
11
13
13
18
18
19
19
21
22
23
24
25
29
31
34
34
11
13
13
75
17a
64
62
20
22
18
19
29
34

DREDGE HEAD WITH MECHANICAL AND PUMPING ACTION

This invention relates to means for collecting solid fragments or particles, especially manganese nodule ore, from the ocean floor in a highly efficient manner, by making use of a combination of hydrodynamic effects plus, in a most preferred embodiment, mechanical dislodging means.

With the recognition of the limited supplies of raw materials, and especially metals, from previously available terrestrial mine sites, a great deal of effort has been put into the development of means to mine valuable metal ores from the abyssal depths of the oceans. Such means have generally centered about the utilization of extremely deep water dredging means, especially at depths of between about 10,000 and 18,000 feet, to bring up what is known as ocean floor nodule ore, or manganese nodules.

The so-called nodule ores, are commonly found lying on the soft sea floor as generally fist-sized or smaller fragments or particles, i.e., aggregate rocks, which are usually partially immersed within the sediment of the ocean floor. The nodule materials, of course, vary greatly in size, from what can be considered relatively small pebbles or even grains, up to relatively large rocks, or even boulders, or, at times, even large flat plates extending over the ocean floor. Granite and other stone boulders are, of course, also often encountered when passing along the deep ocean floor. The terms "fragments" and "pieces" of ore or other solids as used hereinafter includes particles of varying sizes which were broken off from larger whole solids or which are themselves full size as formed in nature, albeit varying from a pebble to a large rock in size.

The extreme conditions met at such great ocean depths, particularly in the way of pressures, have necessitated the development of a new generation of dredging equipment. Generally, the dredging means is connected to a surface vessel by way of a device for bringing the ore from the ocean floor to the surface. The dredging head can be, for example, of the suction nozzle variety, wherein the ore is literally sucked into a nozzle, much in the way of a vacuum cleaner, and then transferred to the vertical means rising to the surface. There have also been utilized mechanical scraping or scouring means to dislodge and collect the nodule ore, before transfer to the means for carrying the ore to the ocean's surface. Such vertical means, as generally utilized in combination with a suction head nozzle, include hydraulic means for lifting the ore suspended in, generally, water. Mechanical means for the removal of such ocean floor ores have also been utilized, including, for example, continuous bucket chains or digging scoops, or rotating wheels having radially extended treads to dislodge and pick up nodule ore chunks, as in U.S. Pat. No. 3,480,326.

Problems which arise in such unusually deep dredging operations include the immediate and direct problems of increasing the efficiency and rate at which the ore can be collected, as well as the long-range and indirect problems of avoiding disruption of the still unknown ecology of the deep oceans, e.g., by polluting the ocean with silt and other material brought up from the abyssal depths with the ore.

Generally, the dredging means, of whatever type, are moved through the water by towing from a surface vessel, utilizing, for example, the length of pipe for hydraulically lifting the ore from the ocean floor to the surface vessel.

In an attempt to improve the recovery rate, for example, of the suction head nozzle-type devices, mechanical means have been employed, such as by way of fingers or probes, thrusting ahead of the nozzle opening to loosen the nodule particles from the ocean floor (see, e.g., U.S. Pat. Nos. 3,429,062 and 3,226,854). Although this has been somewhat successful, there have also been problems created by over-size particles jamming the nozzle and a certain amount of loss caused by smaller particles being swept along the side of the nozzle after being dislodged by the fingers.

In accordance with the present invention, there is provided a dredge device for collecting, for example, manganese nodule ore fragments from the ocean floor, in a highly efficient and efficient manner, with minimal disturbance of the ocean ecology by eliminating the roiling and distribution of ocean floor silt above the level of water immediately adjacent the ocean floor. The dredge device for accomplishing these objects comprises support means for supporting the device on the floor of the sea bed during movement along the floor; a powered, rotating elongated member for collecting ore fragments, the member being positioned such that its longitudinal axis is transverse to, and preferably perpendicular to, the intended direction of movement of the dredging means; means for dislodging and extracting ore fragments from the ocean floor; and conveying means for carrying the ore fragments from the rotating member to holding means adapted to be connected to a device for carrying the ore fragments to the ocean surface.

In accordance with the preferred embodiments of this invention, the rotating member is provided with tines extending radially outwardly from the outer surface of the member, the drum member being so positioned with respect to the support means that when the dredge device is moving along the ocean floor the outermost portion of the tines, at the lowermost point of rotation, makes contact with or cuts into the ocean floor surface, so as to dislodge nodule ore fragments. The ore fragments, after being dislodged, are deposited upon conveying means which preferably brings the ore to an upper rear portion of the dredge device, to be transported vertically to the surface. Preferably, such a vertical transport means involves an air lift means.

Means can also be provided on the conveyor to retain the ore fragments but to permit the elimination by gravity flow of any silt or other small particles entrained with the ore fragments, in a more preferred embodiment.

The preferred embodiment of the present invention utilizes a combination of mechanical and hydrodynamic forces to dislodge and pick up the nodule ore fragments from the ocean floor surfaces. The mechanical force is provided by the tines radiating from the rotating member. The hydrodynamic forces are provided by a combination of a centrifugal force effect, a venturi, or suction, effect, and the tangential acceleration, or Magnus, effect of the rotating drum, which results in a novel 'pump'.

The venturi suction effect is obtained by providing a shrouded inlet in the shape of a nozzle or venturi, wherein the nozzle can be defined wholly by manufactured materials, or, in a most preferred embodiment, the nozzle opening can be defined in part by the ocean floor surface itself. The centrifugal effect is obtained by providing a diverging shroud, or volute, partially surrounding the rotating drum forward of, or upstream from, the rotating member.

Most preferably, in order to provide for the variations in the ocean floor surface, elevation controlling means are provided, together with elevation sensing means, for varying the height of the rotating drum axis in relation to the support level of the dredge device.

A further understanding of the present invention can be obtained by reference to the preferred embodiments for achieving the desired objects and improvements set forth in the illustrations of the accompanying drawings. The illustrated embodiments, however, are merely exemplary of certain presently known preferred means for carrying out the present invention. The drawings are not intended to limit the scope of this invention, but merely to clarify and exemplify, without being exclusive thereof.

Referring to the drawings.

A dredge vehicle chassis, or sled, generally indicated by the numeral 11, is formed with a plurality of intersecting support beams 18, 19. The vehicle is intended to ride along the lower horizontal skids, or runners, 13, on the surface of the ocean floor. The dredge vehicle comprises a chassis frame, generally indicated by the numeral 11, formed of a plurality of intersecting support beams 18, 19. The sled is intended to ride along the lower horizontal skids, or runners, 13 on the ocean floor. The dredge vehicle is connected to a surface vessel 16, for example, through a hydraulic air lift pipe system 12, details of which are not shown.

Figures 1, 2:
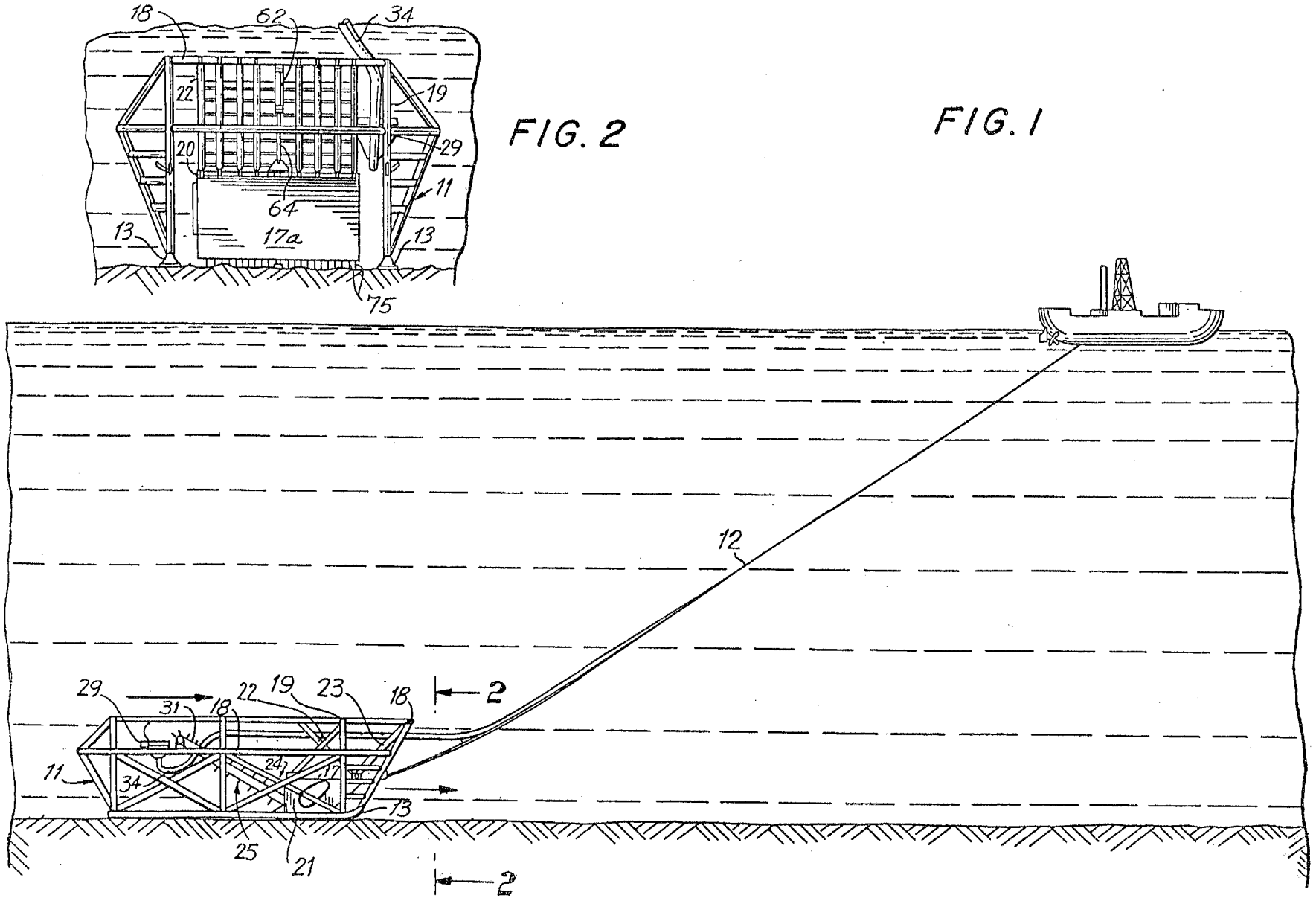
FIG. 1 is a partially diagrammatic side elevation view of a dredge vehicle in accordance with the present invention shown in operation and connected to a surface vessel.
FIG. 2 is a front elevation view of the dredge vehicle taken along lines 2—2 of FIG. 1.
Figure 3:
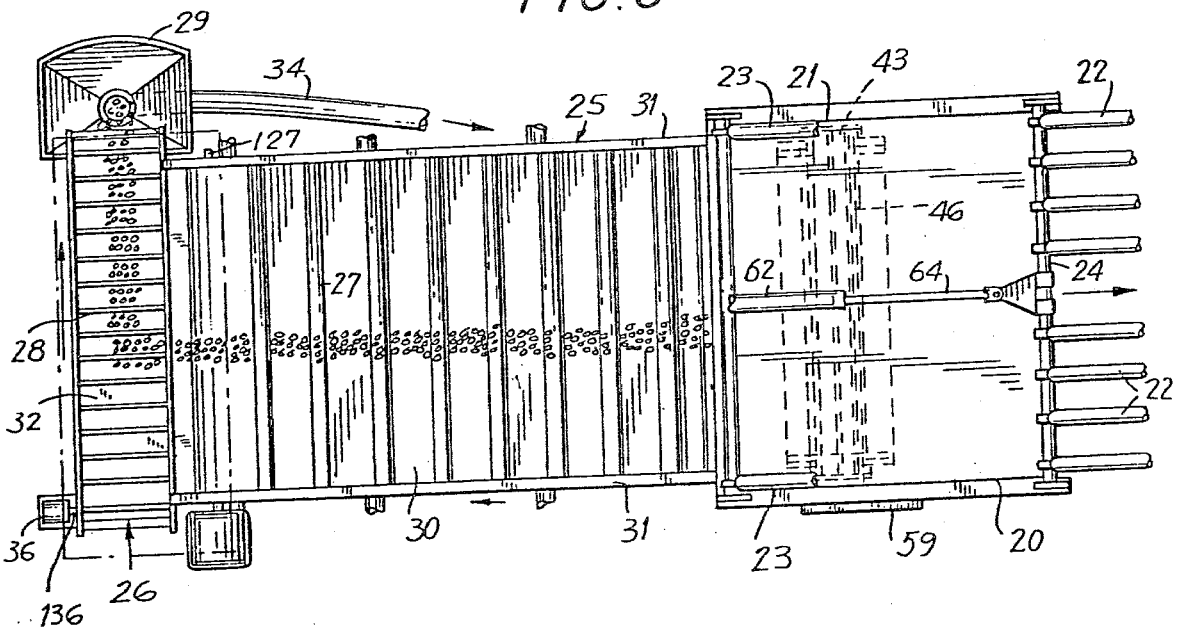
FIG. 3 is a partially broken-away plan view showing the conveyor system of the dredge means in accordance with the present invention.
Figure 4:
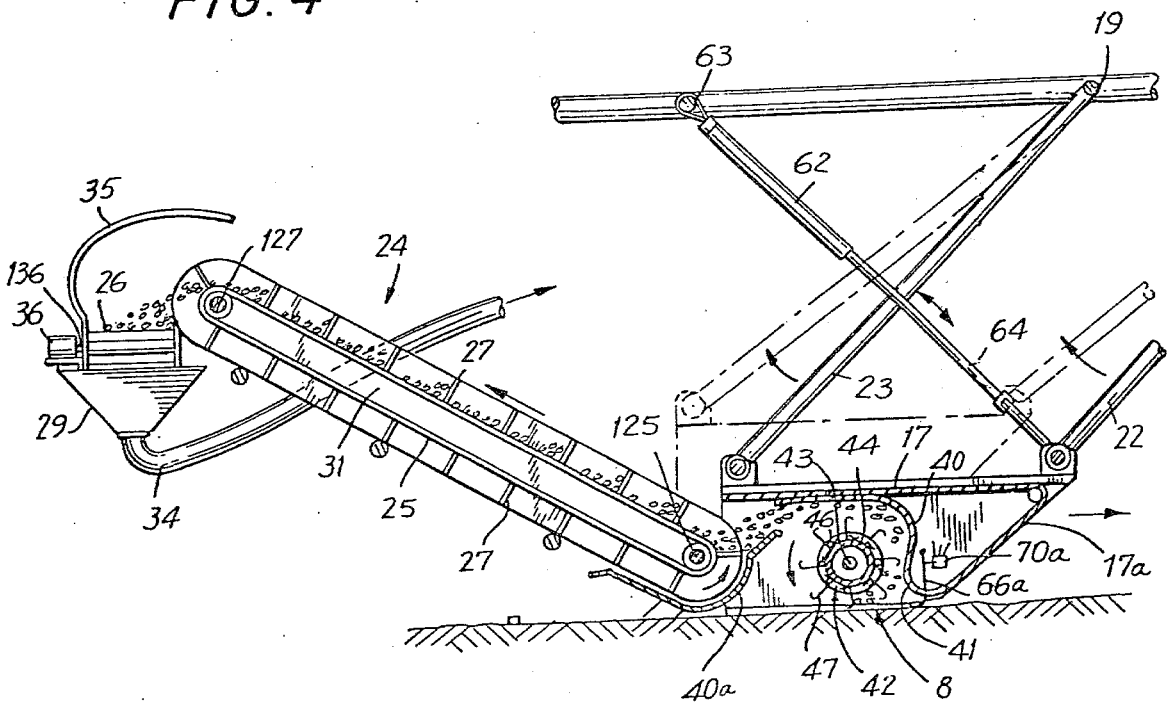
FIG. 4 is a partially broken-away side elevation view, in partial cross-section, showing the conveyor system and rotating drum in operating position.
Figure 5:
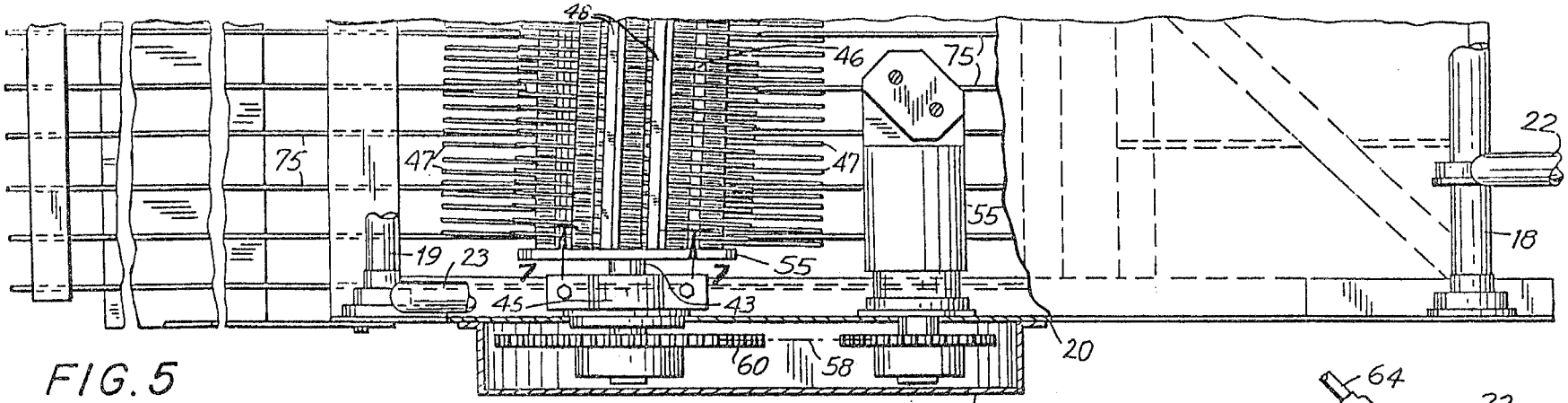
FIG. 5 is a detailed partial plan view of the lower portion of the dredge vehicle including one end of the rotating drum.
Figure 6:
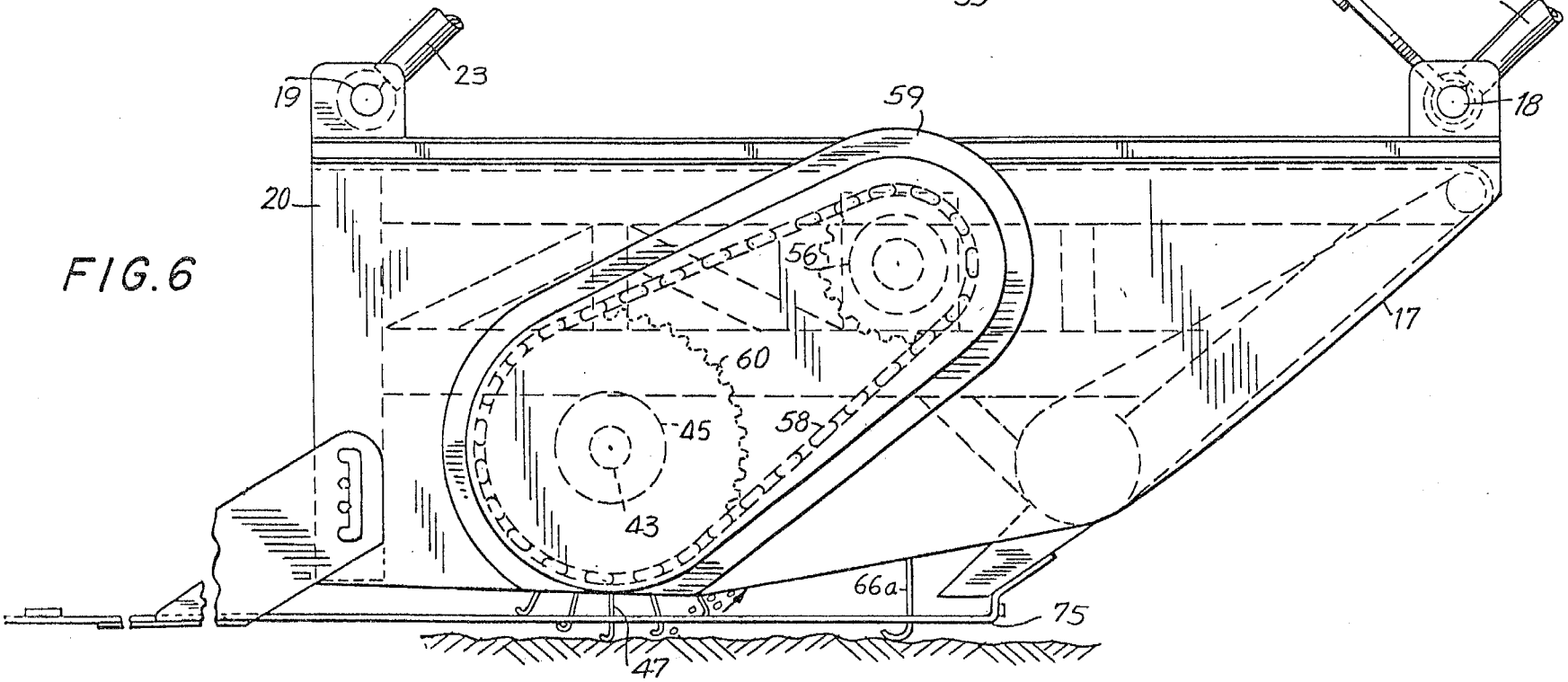
FIG. 6 is a partial side elevational view taken along lines 6—6 of FIG. 5.
Figure 7:
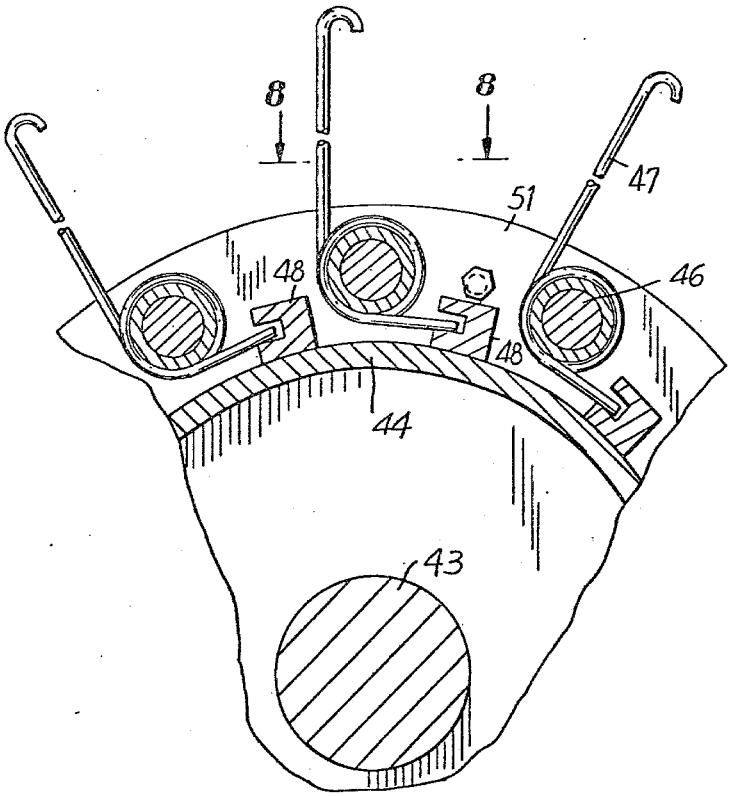
FIG. 7 is a cross-sectional view along lines 7—7 of FIG. 5.
Figure 8:
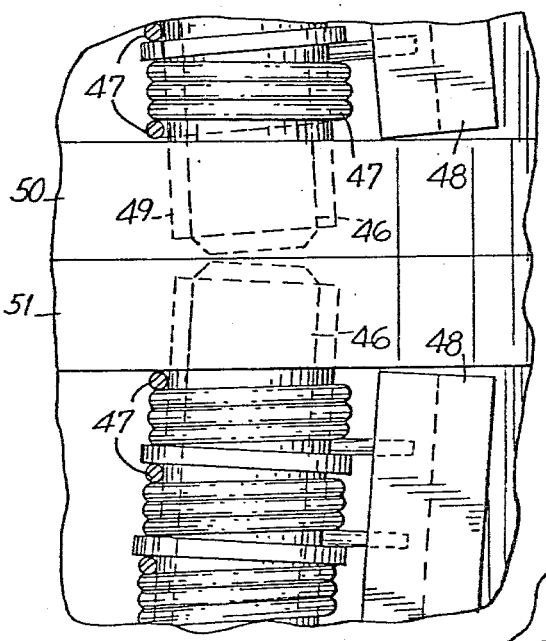
FIG. 8 is a partial detailed plan view along lines 8—8 of FIG. 7.

The collection and conveyor system 24, as depicted in FIGS. 3 and 4, are supported within the sled frame 11. A rotating drum is supported rotatably between two end plates 20, 21. An inclined, axially extending conveyor is flexibly connected to the end plates by two side channels 31.

The end plates are, in turn, supported from hangers 22, 23, pivotally connected and extending downwardly from the upper portion of the sled frame 11. Rollers 123 are rotatably connected to the sides of the sled frame 11 and provide further support beneath the conveyor side channels 31. A transverse conveyor 26 is positioned immediately beneath the upper end of axial conveyor 25, and is rotatably supported on the sled frame 11.

The inclined axial conveyor 25 and the rotating drum 42 can pivot upwardly in relation to the sled frame 11. A hydraulic cylinder 62 is connected to the sled frame 11 by hanger 63. A piston rod 64, slidably connected within the hydraulic cylinder 62, is connected to a rigid bar extending between the two end plates 20, 21, in a pivotable manner.

Figure 12:
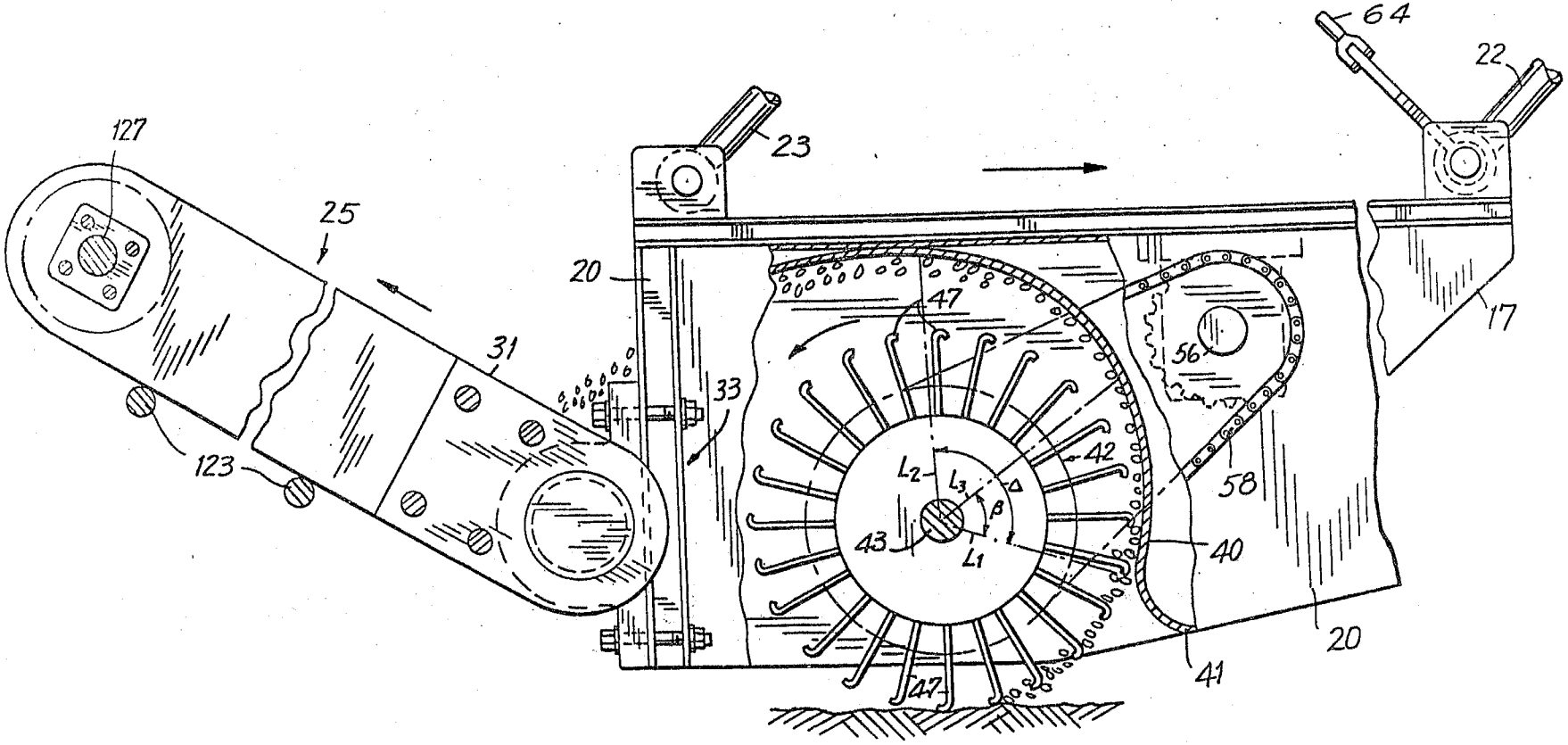
FIG. 12 is a side elevation view showing the support assembly for the rotary drum and inclined conveyor and a diagrammatic sketch showing the operation of the rotating drum including the hydrodynamic effects.

The lower end of the inclined axial conveyor 25 is positioned below and behind the uppermost surface of the rotating drum 42. The lower forward ends of the said channels 31 are flexibly connected to the rearmost portion of end plates 20, 21 respectively. The flexible connection, as shown in FIG. 12, preferably includes a self-aligning pillow block bearing 33 and ball or roller bearings. The pillow block bearing is preferably formed, for example, of resilient material such as rubber, nylon or Nylatron. The flexible pillow block bearing provides sufficient structural support for the side channel 30 in combination with the supporting rollers 123, while at the same time permitting flexing between the conveyor 25 and the end plates 20, 21, during any pivoting motion by the support hangers 22, 23. This flexing motion permits the side channels 31 to remain in contact with the support rollers 123 when the side plates are pivoted upwardly with the rotary drum 42. Thus, the entire lower operating portion of the dredge can be moved out of harms way without placing excessive stress on the connection between the end plates 20, 21 and the conveyor 25.

The transverse conveyor 26 terminates at a position immediately above a hopper 29, for collecting the nodule ore. The hopper 29 is in turn connected to a flexible hose 34 leading to the hydraulic air lift system 12 for transporting the ore fragments to the surface vessel 16.

The gathering portion of the dredge, indicated generally by the numeral 8 in FIG. 4, and depicted diagrammatically in FIG. 12, is defined between the end plates 20, 21 by a diverging curved shroud 40 and a drum fairing 17. The shroud 40 and fairing 17 extend around the drum 42 and form therewith a divergent flow passage, or volute. The ends of the volute are closed by the end plates 20, 21. The inlet to the volute is defined, in the shape of a nozzle, by the forwardmost convex curved surface 41 extending from the shroud 40, when the dredge rests upon the ocean floor. The nozzle opening, therefore, is defined between the curved surface 41 and the ocean floor.

The forward portion 17*a* of the fairing provides a baffle, or flow directing means, directing the flow of water to the inlet nozzle 41 as the dredge moves along the ocean floor. The divergent flow passage is further defined by an outlet formed between the upper rear portion of the shroud 40 and fairing 17 and the uppermost surface of the drum 42. A curved rear shroud 40*a* defines the lowermost portion of the outlet and serves further to direct the flow of water and any entrained ore particles to the lower portion of the conveyor 25. The sides of the divergent flow passage are closed by end plates 20, 21, to insure that the flow of water is from the inlet 41 to the outlet of the divergent passage.

The hydraulic drive motor 55 is secured to the end plate 20 and is operatively connected through driving sprocket 56, drive chain 58 and driven sprocket 60, to the drum shaft 43.

The idler shaft 125 for the axial conveyor belt 25 is rotatably supported by the conveyor side channels 31, e.g. on self-aligning roller or ball bearings, as explained above. The upper, rearward end of the axial conveyor belt 25 is supported by drive shaft 127 which in turn is rotatably connected to the conveyor belt side channels 31. A second hydraulic drive motor 155 is rigidly connected to one of the side channels 31 and operatively connected to the drive shaft 127.

The transverse conveyor 26 is mounted directly beneath the upper rearward end of the axial conveyor 25. The transverse conveyor 26 rotates about two end shafts, an idler shaft, not shown, located immediately above the hopper 29, and a drive shaft 136. The two shafts are rotatably connected to the sled frame 11. A hydraulic drive motor 36 is also mounted on the sled frame 11 and is operatively connected to the drive shaft 136.

The nodule hopper 29 immediately below the outer end of the transverse conveyor 26 is connected vis flexible hose 34 to a vertical riser system for transporting the nodule ore fragments to the surface of the ocean.

The rotating drum 42 is supported on a drum shaft 43 which is in turn rotatably supported by the two bearings 45 connected to the end plates 20, 21. A housing 59 for the hydraulic drive motor 55 for the rotary drum 42 is rigidly connected to the end plate 20.

The rotating drum in the preferred embodiment depicted in FIGS. 3 through 5, 7 and 8, is modular and comprises drum support flanges 144, which in turn are rigidly supported on a drum shaft 43. As shown, the drum is divided into two axial segments; two flanges define the ends of each segment. At the midpoint of the drum, two such support flanges 144 abut. A pipe 44 is rigidly supported on the flanges 144 and extends therebetween. The pipe 44 has a diameter intermediate that of the support flanges 144 and the drum shaft 43. Also mounted upon the support flanges 144, along an annular ring between the outer circumference of the support flange 144 and the outer circumference of the support flange 144 and the outer circumference of the pipe 44, are relatively small diameter heavy-walled pipes 46, toed into the supported flanges 144 at a slight angle transverse to the axis of the pipe 44. The small diameter pipes 46 act as tine-support shafts for the rotary drum 47. Tine-holder bars 48 are rigidly attached to the outer circumference of the drum support pipe 44; one holder bar 48 is adjacent each tine-support shaft 46. Spaced along and extending from the tine-support shafts 46 are spring steel tines 47, each tine being formed by wrapping spring steel about the support shafts 46, one end being locked into a groove formed in the tine-holder bar 48, the other end extending outwardly from the tine-support shaft, substantially along a radius of the support pipe 44.

The axial spacing of the tines along each tine-support shaft 46 is determined by the size of the smallest nodules intended to be harvested. Generally, it is preferred that the tines be spaced such that they will retain nodules above that size. As is explained below, however, the operation of this device permits the harvesting of even smaller nodules because of the hydrodynamic effects encountered during operation of this preferred embodiment.

The length of each tine should be sufficient to permit the tine to penetrate the ocean floor as the rotary drum 42 rotates and the tine reaches its lowest position, while the drum 42 is held sufficiently above the ocean floor to prevent the outer surface of the drum shaft from striking against the most commonly met obstruction on the ocean floor. Oversized boulders can be avoided by pivoting the entire collecting unit upwardly and rearwardly, as explained below.

As noted, the outer ends of each tine in this preferred embodiment are bent so as to point away from the direction of rotation of the drum, to avoid catching on obstacles.

The angular spacing of the tines, i.e., the distance between adjacent tine-support shafts 46, is determined such that the largest nodule to be handled by the rotary drum cannot be wedged between the tines and jammed. The size of such nodules is at least grossly determined by the size of the nozzle inlet opening defined between the nozzle surface 41 and the ocean floor.

The main axial conveyor 25 in the preferred embodiment depicted in these drawings comprises a porous, mesh conveyor belt 30 supported and driven about belt shafts 125 and 127. Vertical risers 27 extend across the porous belt 30 at regular intervals. The vertical risers 27 are themselves also either porous, but relatively rigid members, or individual spokes relatively closely spaced across the width of the belt. The spacing between the spokes, or the pore sizes in a continuous strip of material, should be such as to prevent the passage of the smallest size nodule fragment which it is desired to collect. Preferably, however, the pore sizes and mesh sizes should be sufficiently large to permit the removal, by gravity flow, of, for example, silt material or undesirable fines, as well as any water which may be flowing along the belt.

The transverse conveyor belt 28 is of a similar character to that of the main conveyor 25, albeit somewhat narrower. The speeds of the main conveyor 25 and the transverse conveyor 26 are such as to carry all of the nodule fragments gathered from the rotating drum 42 to the hopper 29. It is useful, however, to limit the speed of the conveyors in order to limit the amount of solid material fed to the hopper 29, in those circumstances where the rate of feed is too great to be handled by the vertical riser system fed through the flexible hose 34. The hopper 29 can overflow when the feed rate is too great, and similarly there is preferably means to control the "dumping" of excess nodules from the hopper or downsteam from the hopper in the event of undesirable clogging or exceeding of capacity in the vertical riser system. Such devices are not a part of this invention and are otherwise known to the art. Examples of such devices include doors along the side of the hopper to open when a sensing system indicates too high a concentration of solid material in the vertical riser system, and, or alternatively, dumping means in the vertical riser system adjacent the hopper, to eliminate excess, undesirable, nodule fragments that might cause a clogging or jamming of the vertical rise system.

Figure 10:
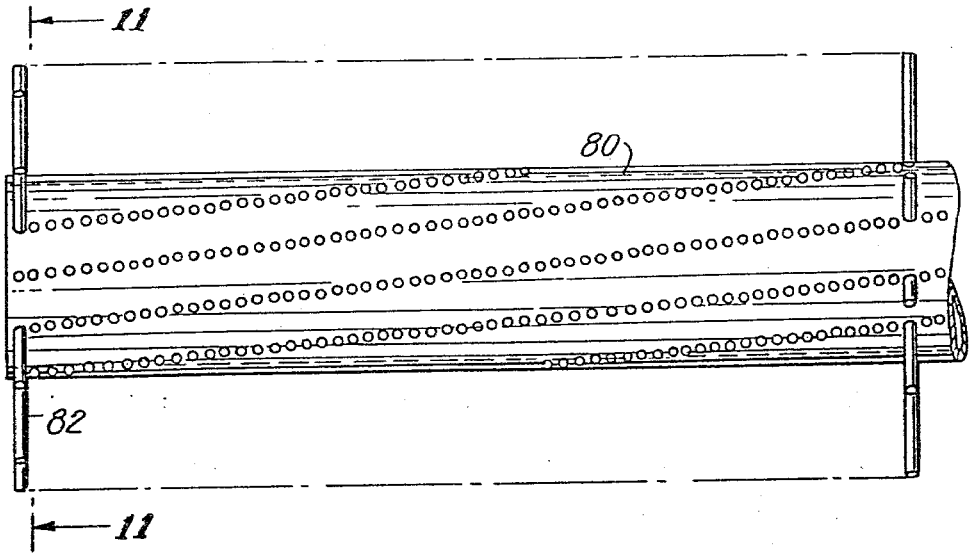
FIG. 10 is a partial side view partially broken-away of an alternative embodiment of a rotating drum in accordance with the present invention.
Figure 11:
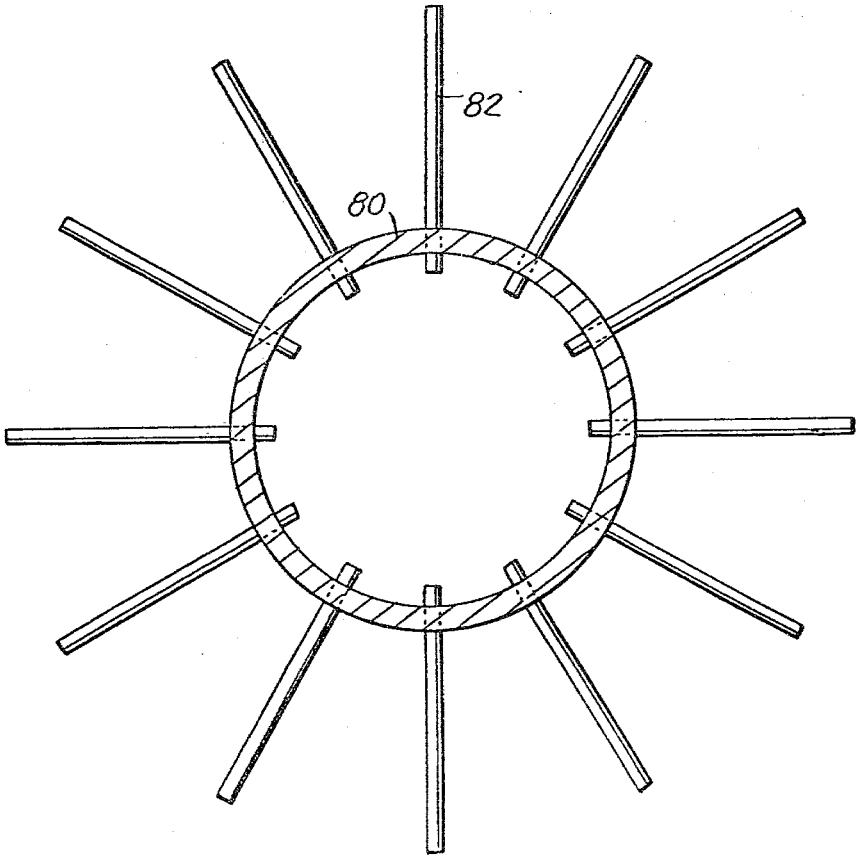
FIG. 11 is a cross-sectional view along lines 11—11 of FIG. 10.

Referring to FIGS. 10 and 11, an alternative, much simpler embodiment of the rotary drum in accordance with the present invention is depicted therein. In this case a simple hollow pipe 80, acts as the rotary drum, and is keyed to fit into the rotary drum support flanges 50,51. The drum 80 has perforations, through the surface of the drum 80, rows of these perforations extending along a line transverse to the axis of the drum 80, so as to form what is substantially a helix around the circumference of the drum 80. Straight, substantially resilient, spokes 82, are friction-fitted into each of the perforations through the drum 80 to provide the tines. There are no curved portions at the end, and it is believed that under most conditions such a simple construction can be utilized in lieu of the more complex construction shown above.

The floor of the sea is often extremely uneven. Further, large boulders or other obstructions are often encountered. These obstructions ore depressions are often a size to fit between the sled runners 13, or other support means, such that the level of the rotary drum 42 does not change to reflect this unevenness. This can result in either failure of the inlet and drum to pick up and contact ore fragments on the ocean floor or in a collision of the drum with the obstruction. To compensate for this unevenness, the combination of the pivotable support hangers 22, 23 and the hydraulic leveler 62 is provided to adjust the height of the drum 42 relative to the runners 13.

Figure 9:
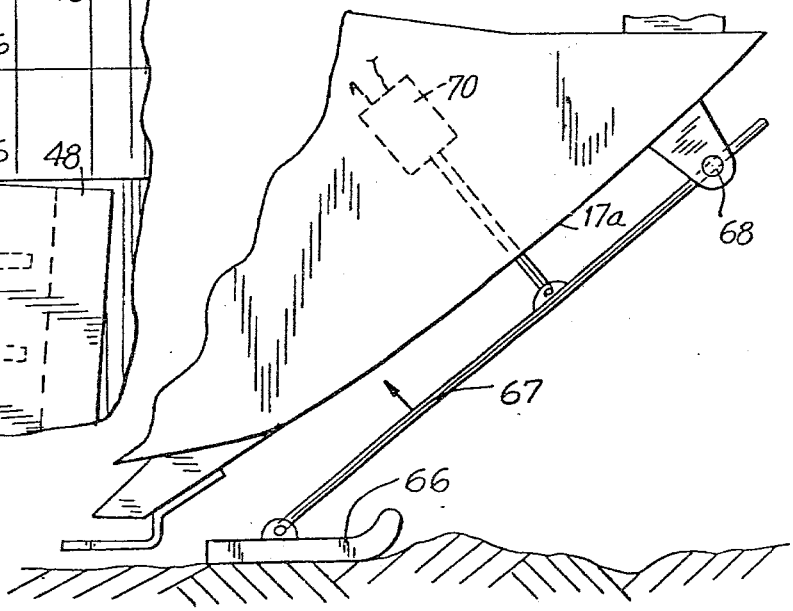
FIG. 9 is a detailed side elevation view of an elevation sensing means in accordance with the present invention.

The height adjustment mechanism for varying the relationship between the support skids 13 of the sled 11 and the gathering-conveying means of the rotary drum 42 and the conveyor 25, is regulated utilizing a level sensor shoe, located either at the inlet 41 to the divergent flow passage, as indicated by shoe **66*a* in FIG. 4, or by a forward shoe 66 as depicted in FIG. 9. In both cases, the shoe is pivotally supported from the main frame of the sled 11 and connected to a hydraulic switch mechanism, e.g., 70, in FIG. 9, or 70*a* in FIG. 4. The switch 70 (or 70*a*) actuates the hydraulic leveler mechanism 62, causing the hydraulic system to draw upwardly the hydraulic leveler rod 64 when the ground level between the main support runners 13 rises or to permit the rod 64 to drop when there is a valley or depression between the sled runners 13**. The precise mechanism by which this hydraulic system operates is known to the art and a more specific description is not necessary.

In addition, means for grossly limiting the size of fragments entering the collection system is provided by the protector skids 75, rigidly connected to the rotary drum fairing 17. The drum protector skids, prevent the entry of oversized ore or rock fragments which might damage the rotary drum, or jam between the rotary drum and the shroud 40.

The operation of the gathering portion of the present invention, especially in its most preferred embodiment, can be clearly seen from the diagram of FIG. 12. The drum is preferably positioned in relation to the ocean floor surface such that the ends of the tines, at their lowest position, cut into the ocean floor surface optimally about $\frac{1}{8}$-inch to $\frac{3}{4}$-inch. When the surface is too hard or compacted to permit such penetration, the flexible, resilient nature of the tines become significant, permitting the tines to bend backwards and then spring back into shape as they come around from their load position. The tine diameter is preferably not greater than about $\frac{1}{8}$-inch to avoid excessive raising of mud and silt from the surface. Any nodules encountered by the tines are thus mechanically lifted from the ocean floor tossed forwardly and upwardly by the rotary motion of the drum, which at the inlet 41 is in a direction transverse to the forward movement of the dredge vehicle. Any nodule thus tossed up and outwardly, will be supported by the tines as the tines rotate with the rotary drum 42, being brought around as the rotor turns and finally being thrown out, by mechanical centrifugal force over the rear rotor shroud **40*a* onto the main axial conveyor 25, where the nodules are also supported by the vertical risers 27; water and silt or other small particles can be filtered out through the mesh of the belt surface. The nodule ore fragments are carried upwardly and rearwardly by the main conveyor 25 until they are spilled out therefrom at the upper end of the main conveyor 25 onto the surface of the transverse conveyor 26, on which they are carried on to the hopper 29. The conveyor hood 35 prevents any nodule fragments from being thrown beyond the transverse conveyor as they come off from the primary conveyor, in the same manner as the continuation of the shroud and fairing 40, 17 direct the nodules from the rotary drum onto the main conveyor. The clearance between the risers 27 and the rear shroud 40*a*** should be sufficiently small so as to prevent loss of significant quantities of gathered nodule ore fragments.

The nodule ore fragments from the ocean floor are gathered also by hydrodynamic effects, which can work together with and supplement the mechanical lifting effect of the tines, or if the tines are inoperative or break off, or are not present on the rotary drum, can usefully gather significant quantities of nodule ore fragments without any mechanical assistance. Part of the hydrodynamic forces are provided by centrifugal pumping action created by the action of the rotary drum 42 and the divergent shroud cover 17. In addition, the forward movement of the dredge vehicle creates a venturi, or nozzle, effect at the nozzle-shaped inlet 41. Finally, the combination of the spinning drum and the forward motion creates an additional, so-called Magnus effect, in the divergent flow passage, which further assists in drawing a stream of water through the inlet area 41. These combined hydrodynamic effects create a substantial flow of water through nozzle area 41 drawing in any loose nodule ore fragments in its path, and further serving to loosen any such fragments embedded in the upper soft surface of the ocean floor.

The centrifugal pumping effect and the magnus effect are both depending upon the rotational velocity of the drum, and the diameter of the drum. Similarly, the shape of the rotor shroud 40 also has its effect. The rotational velocity of the drum, especially when the mechanical effect of the tines is to be considered as a significant factor, is determined by the forward velocity of the dredge vehicle and the radius to the outer tip of the tines, and the angular spacing of the tines. The drum velocity should be such that the trajectories of the tines passing through the ocean floor surface intersect, such that all nodule ore fragments embedded in the surface of the ocean are contacted. Thus, the minimum preferred angular velocity of the drum is determined. A greater velocity can be utilized; however, this is generally unnecessary.

The shape of the rotor shroud can be determined in accordance with the following equation, in order to obtain a preferred divergent flow passage. Referring to the drawing of FIG. 12, $L_b = L_1 + B/\Delta(L_2 - L_1)$. Referring to the drawing of FIG. 12, $L_1$ is the distance between the axis of the rotary drum and the shroud at the inlet point, B is the angle between $L_1$ and $L_B$, $L_2$ is the distance from the axis of the rotary drum to the shroud at the outlet, i.e., along a radius, and $\Delta$ is the angle between $L_1$ and $L_2$. The precise shape of the shroud defined by the above equation is not necessary. It is only required that diverging flow passage be provided in order to obtain the desirable centrifugal and Magnus pumping effects.

In a preferred embodiment of this device, the dredge is towed along the ocean floor at a speed of about 1.5 to 2 knots. The drum 42 has a diameter of about 10–12 inches, the tines extending from the surface of the rotor an additional 5–6 inches. The shroud is positioned at a distance from the drum surface, i.e., the base of the tines, of about 5½ to 7 inches at the inlet.

The patentable embodiments of this invention which are claimed are as follows:

1. A dredge device for collecting ore fragments from the ocean floor, the device comprising:

support means to support and permit the movement along the ocean floor of said dredge device;

a powered rotor for collecting fragments, the rotor being positioned such that its longitudinal axis is transverse to the intended direction of movement of the dredge device;

spoke means extending outwardly from the rotor and positioned with respect to the support means that when the dredge device is moving along the ocean floor the outermost portion of the spoke means, at the lowermost point of rotation, makes contact with the ocean floor surface, so as to dislodge ore fragments;

a curved shroud fairing divergently positioned around the rotor, defining a divergent flow passage with the rotor, the passage having an inlet and an outlet, the outlet being positioned such that water flowing towards the rotor as the dredge device is moved in its expected manner flows through the inlet towards the rotor;

conveying means having a first end and a second end, the first end being positioned adjacent the rotor to pick up ore fragments dislodged by the spoke means on the rotor; and transport connection means, adapted to be connected to transport means for carrying ore fragments from the dredge device on the ocean floor to the ocean surface, the connection means being positioned adjacent the second end of the conveyor means, whereby ore fragments on the conveyor means enter the connection means.

2. The dredge device of claim 1 wherein the spoke means extend outwardly from the surface of the rotor substantially along a radius of the rotor.

3. The dredge device of claim 2 wherein the conveying means comprises a first longitudinal conveyor extending along the direction of movement of the dredge device and a second transverse conveyor extending transversely to such direction, the transverse conveyor continuing to a point adjacent the connection means.

4. The dredge device of claim 3 wherein the conveyor means comprise a porous supporting surface, whereby water and smaller solid fragments, can pass therethrough, but wherein the ore fragments of desired size are retained on the conveyor means, whereby the ore fragments are carried to the transport means connection means but the silt and other fine particles remain adjacent to the ocean floor.

5. The dredge device of claim 4 wherein the spoke means are resilient tines, adjacent tines being separated by a distance substantially equal to the smallest ore fragments desired to be collected.

6. The dredge device of claim 5 comprising in addition transverse means extending outwardly from the conveyor belt, for supporting the ore fragments as the belt moves in a transversely outwardly direction.

7. The dredge device of claim 6 wherein the rotor and first conveyor means are pivotably connected to the support means, whereby the rotor means can follow the contours of the ocean floor as it moves along.

8. The dredge device of claim 7, comprising in addition, elevation adjusting means, operatively connected at one end to the rotor and at the other end to the support means, sensing means for sensing any difference in elevation between the portion of the ocean bed operatively contacting the support means and the portion of the ocean bed beneath the rotor, and actuating means, actuated by the sensing means to actuate the elevation adjusting means, to move the rotor means upwardly or downwardly to insure a substantially constant relationship between the axis of the rotor and the ocean floor immediately therebeneath, whereby the tines contact the ocean floor in a substantially constant manner.

9. The dredge device of claim 1, wherein the inlet to the divergent flow passage is defined between a curved portion of the shroud fairing and the ocean floor, when the dredge device is supported by the ocean floor, in the form of a nozzle.

10. A device for collecting solid ore fragments from the floor of a body of water, the device comprising: support means to support and permit movement along the floor by said collection device; divergent flow passage defining means; inlet means to the narrow end of the divergent flow passage, positioned so as to permit the influx of water to the flow passage at a location immediately adjacent the floor of the body of water; outlet means from the flow passage for water and ore fragments; and means for separating ore fragments from the water and smaller solid particle material; the flow passage defining means comprising a first substantially curved surface and a second substantially curved surface opposed to the first curved surface; the distance separating said first and second curved surfaces increasing between the inlet and the outlet; and drive means for causing closed curvilinear motion of the first curved surface relative to the second curved surface; whereby water immediately adjacent the floor of the body of water is drawn into the inlet together with ore fragments on the floor of the body of water when the collection device is moved along the floor of the body of water.

11. The collection device of claim 10 wherein the first curved surface comprises a drum rotating about its axis.

12. The collection device of claim 11 comprising in addition a plurality of spoke members extending radially outwardly from the outer surface of the rotating drum, the spoke members rotating together with the drum.

13. The collection device of claim 11 wherein the rotating drum is substantially circular in cross-section and wherein the axis of rotation is the center of said circle and further wherein the distance separating the second curved surface from the outer surface of the drum as measured along the radii of the drum, increases along the divergent flow passage in accordance with the following formula:

$$L_B = L_1 + B/\Delta(L_2 - L_1)$$

wherein $L_B$ is the length of a line including the drum radius to any given point on the second surface; $L_1$ is the length of a line including a drum radius to the second surface at the inlet to the passage; $L_2$ is the length of a line including a drum radius to the second surface at the outlet from the passage; B is the angle formed between $L_B$ and $L_1$, and $\Delta$ is the angle between $L_1$ and $L_2$.

14. A collection device for gathering ore fragments from the ocean floor, the device comprising:

support means for supporting said device during movement along the ocean floor;

divergent water flow passage defining means operatively mounted on the support means, the flow passage extending along a direction from the front to the rear of the collection device;

inlet means at the narrow end of the flow passage, positioned, relative to the support means, to receive flow of the water immediately adjacent the ocean floor when the collection device is moving along the floor;

outlet means from the flow passage;

the flow passage defining means comprising the surface of a rotor and a second substantially curved surface opposite the rotor surface, the distance separating the drum surface from the second curved surface increasing between the inlet and the outlet;

drive means for causing the rotation of the rotor; and, separating means for separating the ore fragments from the water and any relatively small particles suspended therein.

15. The collection device of claim 14 comprising in addition solids transport connection means for connecting the separating means to means for carrying the nodule ore to the upper surface of the water.

16. The collection device of claim 15 wherein the inlet means is defined by a convergent surface, whereby a venturi effect is obtained by water flowing into the divergent flow passage inlet.

17. The collection device of claim 15 comprising in addition spokes attached to the outer surface of the rotor and extending radially outwardly towards the second curved surface whereby a centrifugal pumping effect is obtained when the rotor is caused to rotate.

18. The collection device of claim 15 comprising in addition conveyor means mounted upon the support means and positioned between the outlet from the divergent flow passage and the means for raising the nodule ore fragments to the surface of the water.

19. The collection device of claim 18 wherein the conveyor means comprises a porous surface positioned for conveying the ore fragments from the outlet in a direction parallel to the movement of the collection device along the ocean floor and outwardly in a direction from the ocean floor toward the ocean surface.

20. The collection device of claim 13 wherein the inlet is in the shape of a nozzle.

* * * * *